US008561224B2

(12) United States Patent
Cook

(10) Patent No.: US 8,561,224 B2
(45) Date of Patent: Oct. 22, 2013

(54) HANDICAPPED ACCESSIBLE SHOWER ENCLOSURE WITH RAMP AND/OR FLOOR PAN

(76) Inventor: Joseph B. Cook, Parkland, FL (US)

( * ) Notice: Subject to any disclaimer, the term of this patent is extended or adjusted under 35 U.S.C. 154(b) by 846 days.

(21) Appl. No.: 12/706,761

(22) Filed: Feb. 17, 2010

(65) Prior Publication Data

US 2011/0197351 A1 Aug. 18, 2011

(51) Int. Cl.
*A47K 3/28* (2006.01)

(52) U.S. Cl.
USPC ..... 4/604; 4/613

(58) Field of Classification Search
USPC ..... 4/596, 604, 612, 613
See application file for complete search history.

(56) References Cited

U.S. PATENT DOCUMENTS

| | | | |
|---|---|---|---|
| 845,526 | A | 2/1907 | Collins |
| 1,017,167 | A | 2/1912 | Pleins |
| 1,684,503 | A | 9/1928 | Nilson |
| 1,873,424 | A | 8/1932 | Kerr et al. |
| 2,025,814 | A | 12/1935 | Goss |
| 2,055,173 | A | 9/1936 | Deubelbeiss |
| 2,197,874 | A | 4/1940 | Myers |
| 2,400,683 | A | 9/1944 | Burnett |
| 2,389,724 | A | 11/1945 | Falco |
| 2,394,594 | A | 2/1946 | Cohn |
| 2,449,323 | A | 9/1948 | Richterkessing |
| 2,467,074 | A | 4/1949 | Birdwell et al. |
| 2,757,385 | A | 8/1956 | Whittick |
| 2,836,830 | A | 4/1957 | Norman |
| D206,220 | S | 11/1966 | Flores |
| 3,363,267 | A | 1/1968 | Kaiser et al. |
| 3,501,879 | A | 3/1970 | Mitchell et al. |
| 3,551,918 | A | 1/1971 | Bergmark |

(Continued)

FOREIGN PATENT DOCUMENTS

| | | |
|---|---|---|
| EP | 0333168 | 9/1989 |
| FR | 2701828 | 9/1994 |

(Continued)

OTHER PUBLICATIONS

T. Clear Corporation; Finpan Concrete Backer Board; Preformed Bathroom Components; http://finpan.com/utilacrete/performed.html; dated Sep. 20, 2006; 3 pages.

(Continued)

*Primary Examiner* — Huyen Le
(74) *Attorney, Agent, or Firm* — Kevin P. Crosby; GrayRobinson, P.A.

(57) ABSTRACT

A bathroom floor module is used in conjunction with a fully or partially curbless, handicapped-accessible, waterproof shower module. The bathroom floor module defines one or more drain apertures to mate with a bathroom floor drain. The bathroom floor module and shower module mate to define a contiguous surface over which a bathroom floor and/or wall tile can be applied to create a transition between the bathroom floor and shower over which a wheelchair can be easily rolled. Installation of the handicapped accessible shower comprises installing the shower module, by adhering the bathroom floor module on the bathroom floor, placing an edge of the bathroom floor module in registry with an edge of the shower module, sealing the joint formed between the edges of the shower and bathroom modules, and installing a finishing surface material over the floor and sidewalls of the shower module, and over the bathroom floor module and threshold.

8 Claims, 15 Drawing Sheets

(56) References Cited

U.S. PATENT DOCUMENTS

| | | | | |
|---|---|---|---|---|
| 3,606,617 | A | 9/1971 | Frazier | |
| 3,675,384 | A | 7/1972 | Knecht | |
| 3,800,335 | A | 4/1974 | Buonaura | |
| 3,992,825 | A | 11/1976 | May | |
| 4,067,072 | A | 1/1978 | Izzi | |
| 4,146,939 | A | 4/1979 | Izzi | |
| D255,829 | S | 7/1980 | Swenson | |
| 4,423,528 | A | 1/1984 | Wiedmeier | |
| 4,462,123 | A | 7/1984 | Morris et al. | |
| 4,541,132 | A | 9/1985 | Long | |
| 4,557,004 | A | 12/1985 | Piana | |
| 4,561,134 | A | 12/1985 | Mathews et al. | |
| 4,694,513 | A | 9/1987 | Kiziah | |
| 4,910,811 | A | 3/1990 | Izzi, Sr. | |
| 4,928,329 | A * | 5/1990 | Palmeri | 4/552 |
| 4,938,825 | A | 7/1990 | Macdonald | |
| 4,974,269 | A | 12/1990 | Baus | |
| 4,987,619 | A | 1/1991 | Smith | |
| 4,993,087 | A | 2/1991 | Roquebrune | |
| 4,993,201 | A | 2/1991 | Bunyard | |
| 5,090,068 | A | 2/1992 | Zellner | |
| 5,092,002 | A | 3/1992 | Powers | |
| 5,159,723 | A | 11/1992 | Benedict | |
| D335,336 | S | 5/1993 | Stiefel | |
| 5,224,224 | A | 7/1993 | Hintz et al. | |
| 5,243,798 | A | 9/1993 | Elliot | |
| 5,289,599 | A | 3/1994 | Hintz et al. | |
| 5,299,330 | A | 4/1994 | Moore et al. | |
| D349,950 | S | 8/1994 | Cummings | |
| D351,019 | S | 9/1994 | Moore et al. | |
| 5,371,980 | A | 12/1994 | Dix | |
| D354,117 | S | 1/1995 | Nations | |
| 5,435,021 | A | 7/1995 | Williams | |
| D363,342 | S | 10/1995 | Dannenberg et al. | |
| D367,522 | S | 2/1996 | Debs | |
| 5,718,008 | A | 2/1998 | Pane | |
| D392,724 | S | 3/1998 | Lenardon | |
| 5,845,347 | A | 12/1998 | Young | |
| 5,913,777 | A | 6/1999 | Gerber | |
| D414,850 | S | 10/1999 | McKeone | |
| 6,003,169 | A | 12/1999 | Davis, Jr. | |
| 6,058,659 | A | 5/2000 | Astrom | |
| 6,094,757 | A | 8/2000 | Torres | |
| 6,155,015 | A | 12/2000 | Kirby | |
| 6,175,971 | B1 | 1/2001 | O'Neil | |
| 6,178,571 | B1 | 1/2001 | McAllister | |
| 6,240,578 | B1 | 6/2001 | Planella | |
| 6,381,773 | B1 | 5/2002 | McAllister | |
| 6,571,406 | B2 | 6/2003 | Gerloff | |
| D480,455 | S | 10/2003 | Painter et al. | |
| 6,643,863 | B1 | 11/2003 | Gerber | |
| 6,687,925 | B2 | 2/2004 | Minnick | |
| 6,698,037 | B2 | 3/2004 | Lippé | |
| 6,725,470 | B2 | 4/2004 | Webb | |
| 6,735,793 | B2 | 5/2004 | Peterson | |
| 6,766,545 | B2 | 7/2004 | Hodges | |
| D495,787 | S | 9/2004 | Helmetsie et al. | |
| 6,851,133 | B1 | 2/2005 | Nehring | |
| 6,990,695 | B2 | 1/2006 | Grayson | |
| 7,007,315 | B2 | 3/2006 | Stonecipher | |
| 7,028,349 | B2 | 4/2006 | Helmetsie et al. | |
| 7,100,331 | B2 | 9/2006 | Nehring | |
| 7,296,309 | B2 | 11/2007 | Nehring | |
| 8,201,287 | B2 * | 6/2012 | Oetting | 4/613 |
| 2001/0052148 | A1 | 12/2001 | Hasenkopf | |
| 2002/0066140 | A1 | 6/2002 | Gerloff | |
| 2003/0033668 | A1 | 2/2003 | Pane | |
| 2003/0089059 | A1 | 5/2003 | Kirby | |
| 2004/0034922 | A1 | 2/2004 | Grayson | |
| 2004/0237187 | A1 | 12/2004 | Stonecipher | |
| 2005/0028270 | A1 | 2/2005 | Nehring | |
| 2005/0050628 | A1 | 3/2005 | Mascheroni | |
| 2005/0081290 | A1 | 4/2005 | Stimpson | |
| 2005/0283900 | A1 | 12/2005 | Campbell | |
| 2006/0026752 | A1 | 2/2006 | Torres | |
| 2006/0213006 | A1 | 9/2006 | Rush, Jr. et al. | |
| 2008/0222793 | A1 | 9/2008 | Cook | |
| 2008/0222794 | A1 | 9/2008 | Cook | |
| 2008/0222795 | A1 | 9/2008 | Cook | |
| 2008/0222796 | A1 | 9/2008 | Cook | |
| 2008/0222797 | A1 | 9/2008 | Cook | |
| 2008/0222891 | A1 | 9/2008 | Cook | |
| 2008/0229494 | A1 | 9/2008 | DeGooye et al. | |
| 2009/0241258 | A1 | 10/2009 | Cook | |
| 2010/0024107 | A1 | 2/2010 | Stimpson | |
| 2010/0263188 | A1 | 10/2010 | Cook | |

FOREIGN PATENT DOCUMENTS

| | | | |
|---|---|---|---|
| GB | 2093342 | A | 9/1982 |
| GB | 2108382 | A | 5/1983 |
| GB | 2270836 | A | 3/1994 |
| GB | 2271713 | A | 4/1994 |
| JP | 53036570 | | 4/1978 |
| JP | 54038649 | A | 3/1979 |
| JP | 5017981 | A | 1/1993 |
| JP | 5017982 | A | 1/1993 |
| JP | 2005187138 | A | 7/2005 |
| WO | WO 98/51202 | | 11/1998 |
| WO | WO 2008/115467 | A2 | 9/2008 |

OTHER PUBLICATIONS

Custom size Corian and Acrylic shower bases and shower surrounds made to any size, shape, and drai . . . ; 1 page; KBRS Manufacturing, Inc., The Perfect Fit; http://showerbase.com-/ ; dated Sep. 20, 2006.

Bonsai American—Tile Products; http://www.bonsal.com/tileproducts_view.html?id=Qg46YHV5eng%30 ,dated Sep. 16, 2006; 5 pages.

International Search Report and Written Opinion for International Application No. PCT/US08/003490 dated Oct. 21, 2008 ( 9 pages).

International Search Report and Written Opinion dated Aug. 23, 2010 issued by the Korean Intellectual Property Office as International Searching Authority in connection with International Application No. PCT/US2010/001313 (9 pages).

* cited by examiner

HANDICAPPED ACCESSIBLE SHOWER ENCLOSURE WITH RAMP AND/OR FLOOR PAN

BACKGROUND OF THE INVENTION

1. Field of the Invention

The present invention relates generally to prefabricated waterproof shower and floor modules and, more particularly, to handicapped-accessible shower and bathroom floor modules and methods for manufacturing and installing same to produce a tiled shower enclosure and adjacent bathroom floor that is handicapped-accessible and prevents water intrusion onto the bathroom subfloor.

2. Description of the Prior Art

The inventor is unaware of any waterproof shower modules which are handicapped-accessible and which are used in conjunction with either a bathroom floor module, which bathroom floor module has associated therewith a floor drain to permit the drainage of water which escapes the shower onto the bathroom floor, and/or an integrated ramp or floor extension, both of which bathroom floor module and integrated ramp or extension can be tiled. Although showers have been proposed which permit ready access by handicapped persons without those persons having to cross a significantly raised threshold or curb, none combine a prefabricated waterproof shower module with a curbless or low curb entry and a prefabricated waterproof bathroom floor pan attachable to, or integrally manufactured with the module, both of which can be tiled.

Therefore, a need exists for, among other things, drain apertures adapted to mate with one or more bathroom floor drains, and/or (b) the waterproof shower module is manufactured with an integrated tileable ramp, and further wherein the bathroom floor module and waterproof shower module, with or without the integrated ramp, mate in such a way as to define a contiguous surface over which bathroom floor and/or wall tile can be applied to create an unnoticeable transition between the bathroom sub-floor and shower.

A need also exists for a prefabricated shower module having one or more side edges forming a barrier free access threshold which includes a waterproof floor panel integrally formed with each threshold edge to prevent water which has seeped through the adjacent grout from contacting the subfloor.

DETAILED DESCRIPTION OF EXEMPLARY EMBODIMENT(S)

Figure 1:
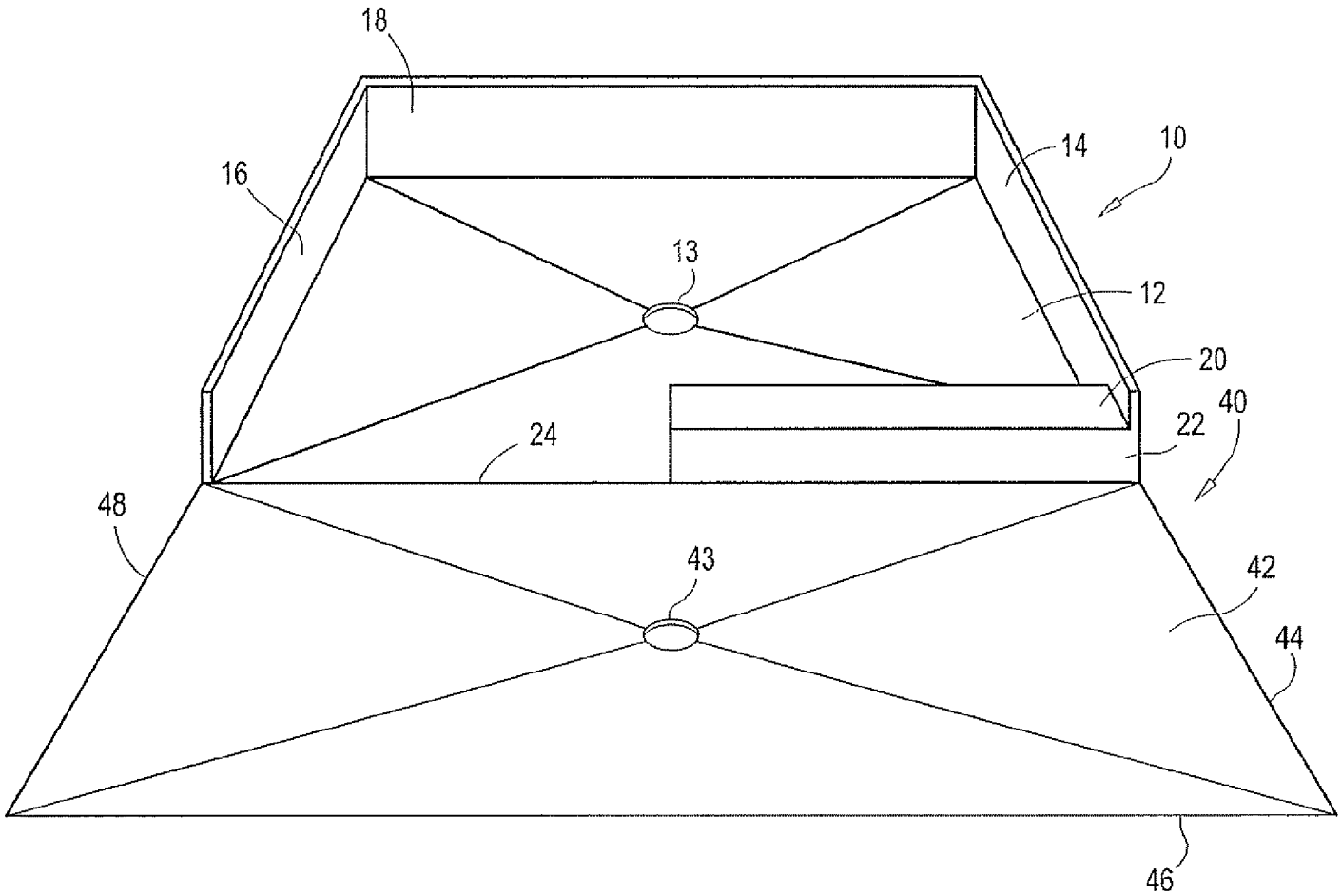
FIG. 1 is a front/top perspective view of a complete shower enclosure system constructed using a prefabricated waterproof shower module having a partially barrier-free handicapped accessible threshold, a prefabricated modular partial curb, and a prefabricated handicapped accessible bathroom floor pan in accordance with an exemplary embodiment of the present invention.
Figure 2:
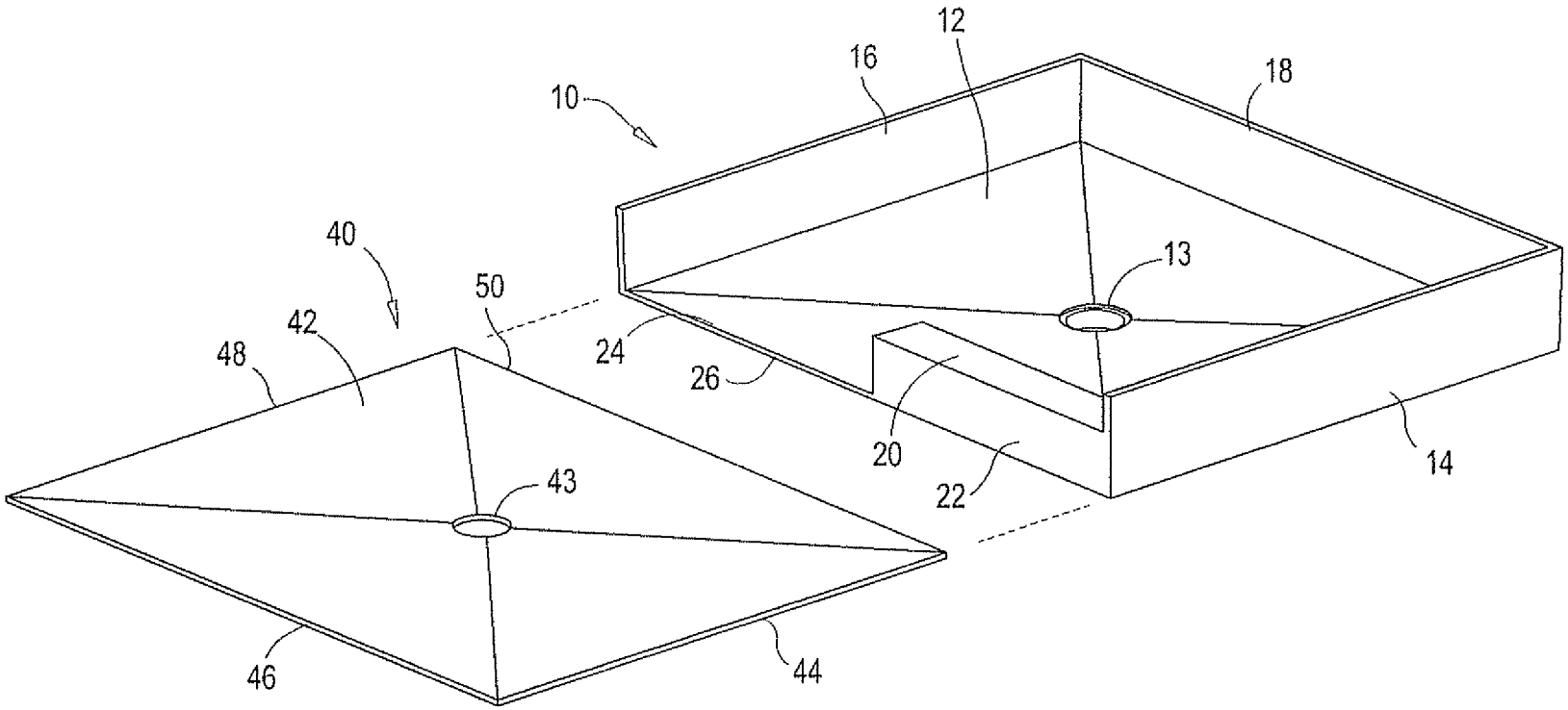
FIG. 2 is a right side exploded perspective view of the handicapped accessible shower and bathroom floor pan in accordance with this invention.
Figure 3:
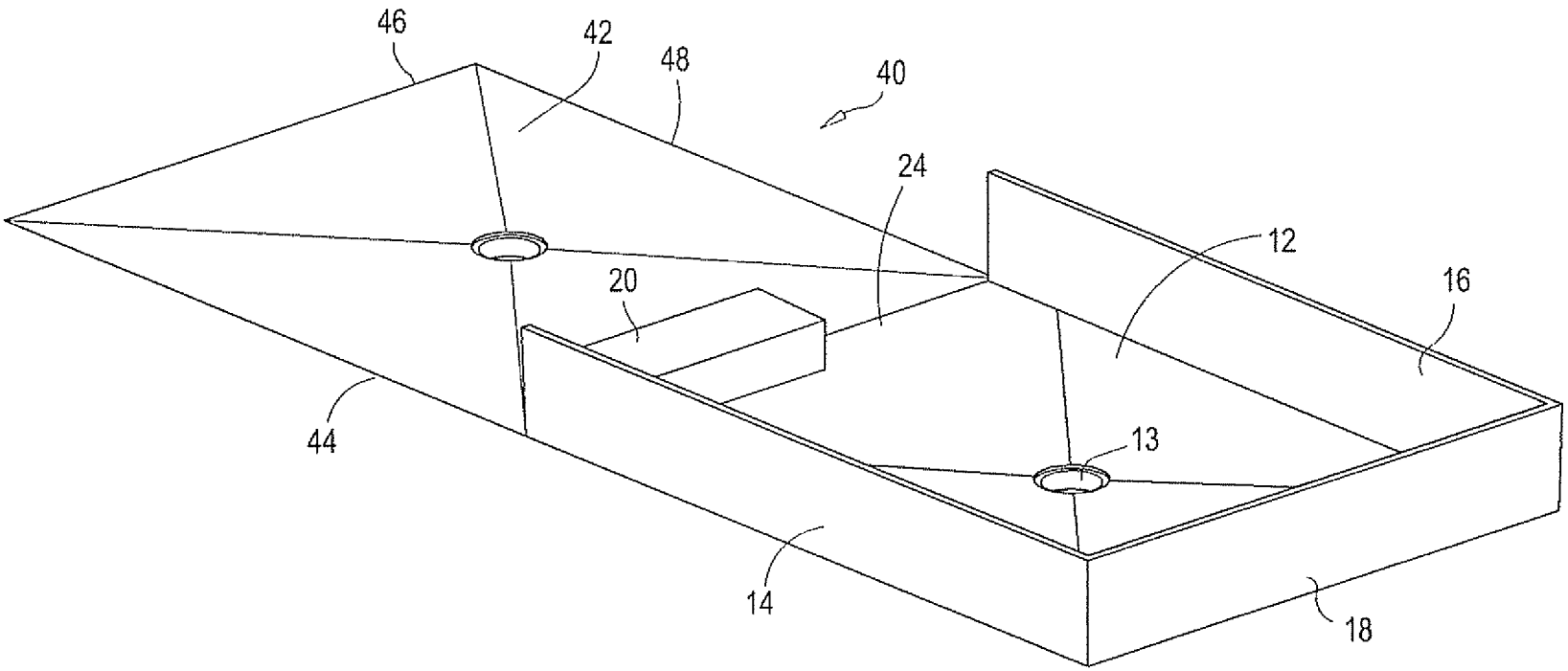
FIG. 3 is a left side perspective assembled view of the handicapped accessible shower and bathroom floor pan in accordance with this invention.
Figure 4:
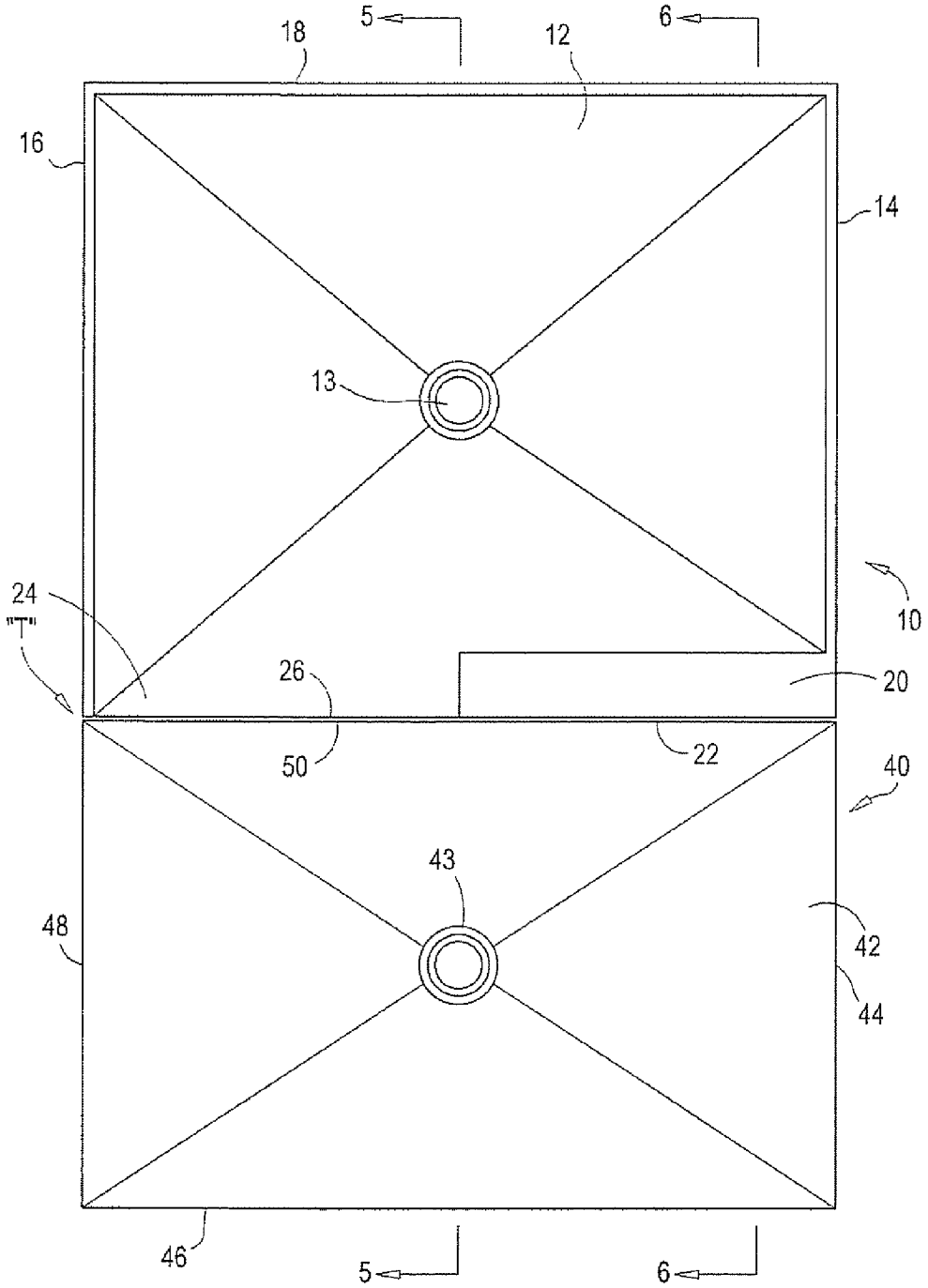
FIG. 4 is a top plan view of the handicapped accessible shower and bathroom floor pan in accordance with this invention.
Figure 5:
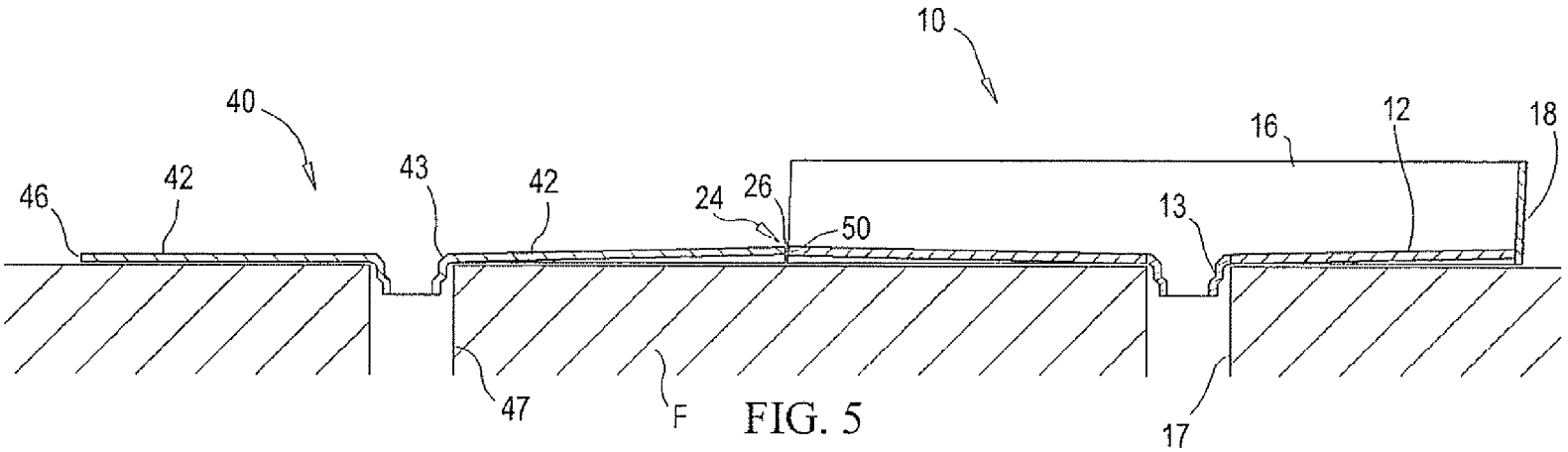
FIG. 5 is a cross-sectional elevational view of the handicapped accessible shower and bathroom floor pan in accordance with this invention taken along lines 35-35 of FIG. 34.
Figure 6:
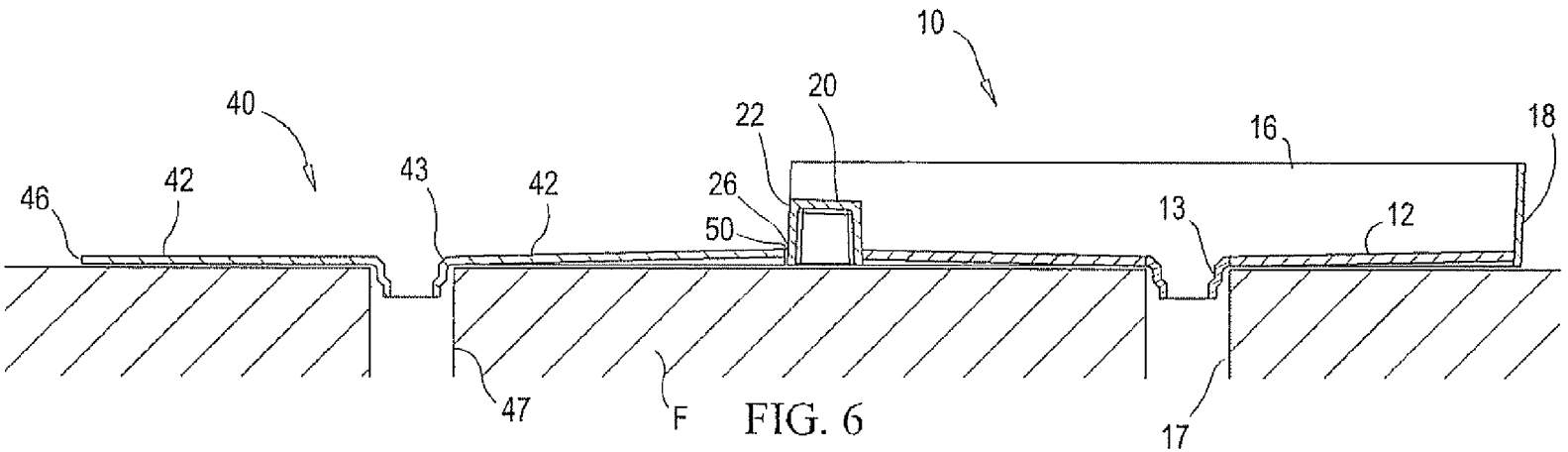
FIG. 6 is a cross-sectional elevational view of the handicapped accessible shower and bathroom floor pan in accordance with this invention taken along lines 36-36 of FIG. 34.

Before describing in detail exemplary embodiments that are in accordance with the present invention, it should be observed that the embodiments reside primarily in combinations of apparatus components and processing steps related to implementing a method and apparatus for waterproofing a handicapped accessible shower enclosure having surfaces for receiving shower tile or stone thereon. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element. The term "tile" also encompasses "stone" and/or "marble" and/or any other finishing material. The term "tiled" means any surface having tile, stone, marble, and/or any other finishing material applied thereon. The term "sidewall," in relation to a shower module, means any vertical surface rising above the floor of the shower module along one or more peripheral edges and may be any height or any width, including, without limitation, an integrated curb. The term "ramp," in relation to a shower module, means any horizontal surface either integrated into a shower module adjacent to the barrier free entrance to the shower or separately manufactured and placed adjacent to the barrier free entrance to a shower module, and in either case, which ramp either eliminates or reduces any vertical obstruction to a barrier free entrance to the shower module.

Generally, the present invention encompasses a prefabricated modular system for constructing a tiled shower enclosure using the combination of a prefabricated waterproof shower module and an associated handicapped accessible floor pan and integral floor drain and/or floor extension or ramp, both of which can be tiled. In a preferred embodiment, a prefabricated leak-proof shower module suitable for use in constructing a tiled shower includes a plurality of sidewalls 14, 16 and 18, and a floor 12. The floor 12 has an upper surface which slopes downward from each sidewall toward a drain aperture 13 and a lower or floor-facing surface with a plurality of support ribs R, where each support rib R extends downward from the lower surface to terminate in a common horizontal plane. The shower module may be created using polyurethane reaction injection molding processing.

The preferred embodiment of the invention lies in the use of a shower pan 10 having a portion of the threshold 24 thereof handicapped-accessible, such that a wheelchair or other mobility-assisting apparatus, or a walking person, can be easily moved over the threshold between a bathroom subfloor F and a shower enclosure.

FIG. 1 is a front/top perspective view of a partially complete shower enclosure system constructed using a prefabricated waterproof shower module having a partially or completely barrier-free threshold 24, a prefabricated modular partial curb 20, and a prefabricated handicapped accessible bathroom floor pan 40. A modular shower pan such as pan 10 may be employed. All that is required of pan 10 with respect to this aspect of the invention is that all or a portion of the open area or threshold 24 associated with the transition from the shower enclosure to the bathroom floor F adjacent thereto be curbless. One type of curbless threshold is one which is substantially "barrier-free." By barrier-free is meant that a wheelchair or similar device can roll over the threshold without undue interference by a lip or curb. The Americans With Disabilities Act ("ADA") has very specific requirements in order for a shower enclosure to be deemed in compliance with that Act. The characteristics, size, shape and orientation of the threshold 24 employed in the preferred embodiment of this invention are intended to comport with the ADA, although other characteristics, sizes, shapes and orientations of the threshold 24 are contemplated to also be within the scope of this invention.

In the embodiment shown in FIGS. 1-6, the threshold 24 between bathroom floor F and shower module 10 is partially barrier-free (i.e. curbless) and partially occupied by a curb 20 (i.e. curbed). It is to be understood, however, that the threshold 24 may be completely barrier-free or any combination of barrier-free and curbed, such that curb 20 may be larger, smaller, or entirely eliminated.

A waterproof bathroom floor pan module 40 is employed in connection with this aspect of the invention, and is defined by a floor covering pan section 42 which defines peripheral edges 44, 46, 48 and 50. Peripheral or threshold edge 50 is adapted to butt up against or be installed in close proximity to peripheral or threshold edge 26 of shower module 10 to reduce or eliminate any threshold barrier from the shower module to the shower floor. Waterproofing as may occur to those of skill in the art may be used to prevent water from passing in the space between edge 26 of shower module 10 and edge 50 of bathroom floor pan 40.

Figure 7:
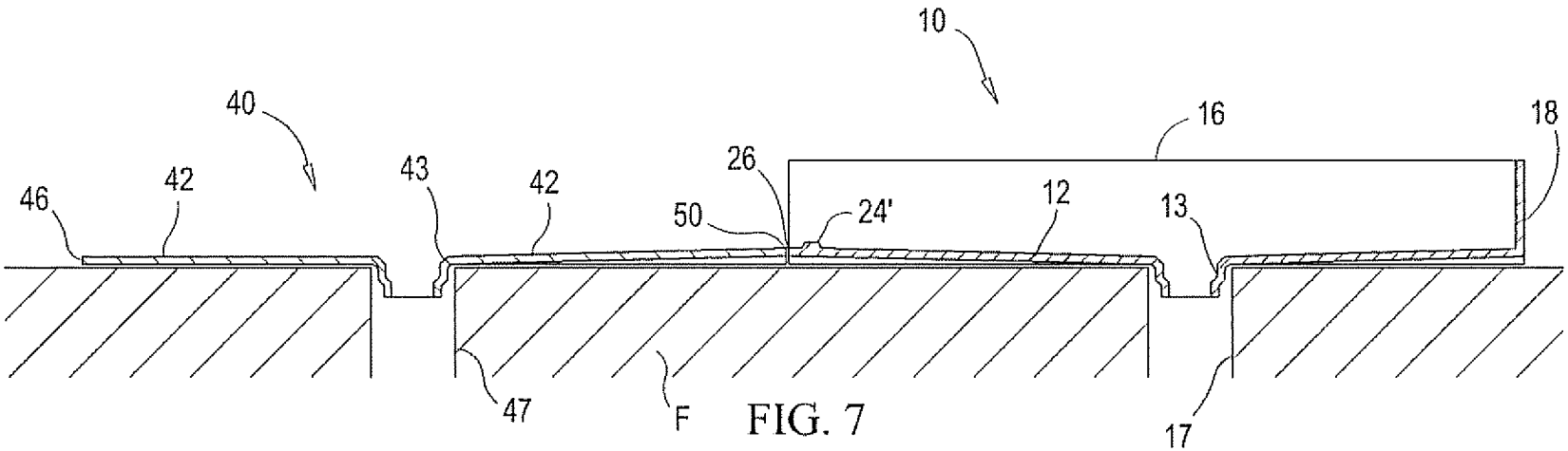
FIG. 7 is a cross-sectional elevational view of the handicapped accessible shower and bathroom floor pan in accordance with this invention taken along lines 5-5 of FIG. 3, but where a raised area 24' is added.

As shown in FIG. 7, a raised area or dam 24' may be added to threshold 24 to act as a barrier to water which may accumulate on floor 12 of module 10 during use of the shower. Such a raised area may take any convenient shape so long as it accomplishes the task of retaining as much water within the shower enclosure as possible while still allowing reasonable passage of wheelchairs or walkers thereover. Raised area 24' extends across the entirety of threshold 24, either between sidewall 16 and curb 20, or between sidewalls 16 and 14 where curb 20 is eliminated.

Figure 8:
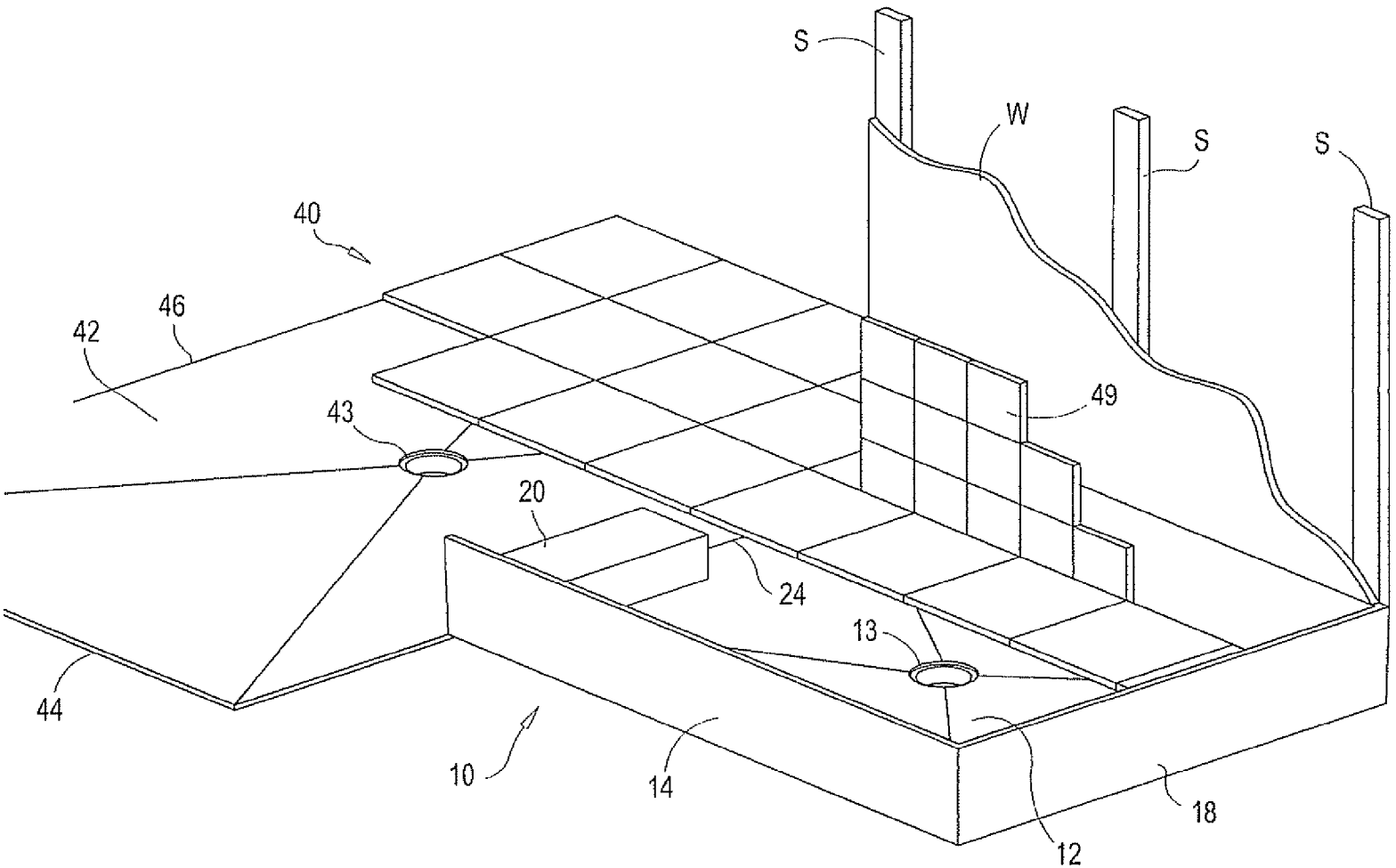
FIG. 8 is a rear perspective view of the handicapped accessible shower and bathroom floor pan arrangement shown in FIG. 3 with wall studs, drywall and tile partially enclosing/covering same.
Figure 9:
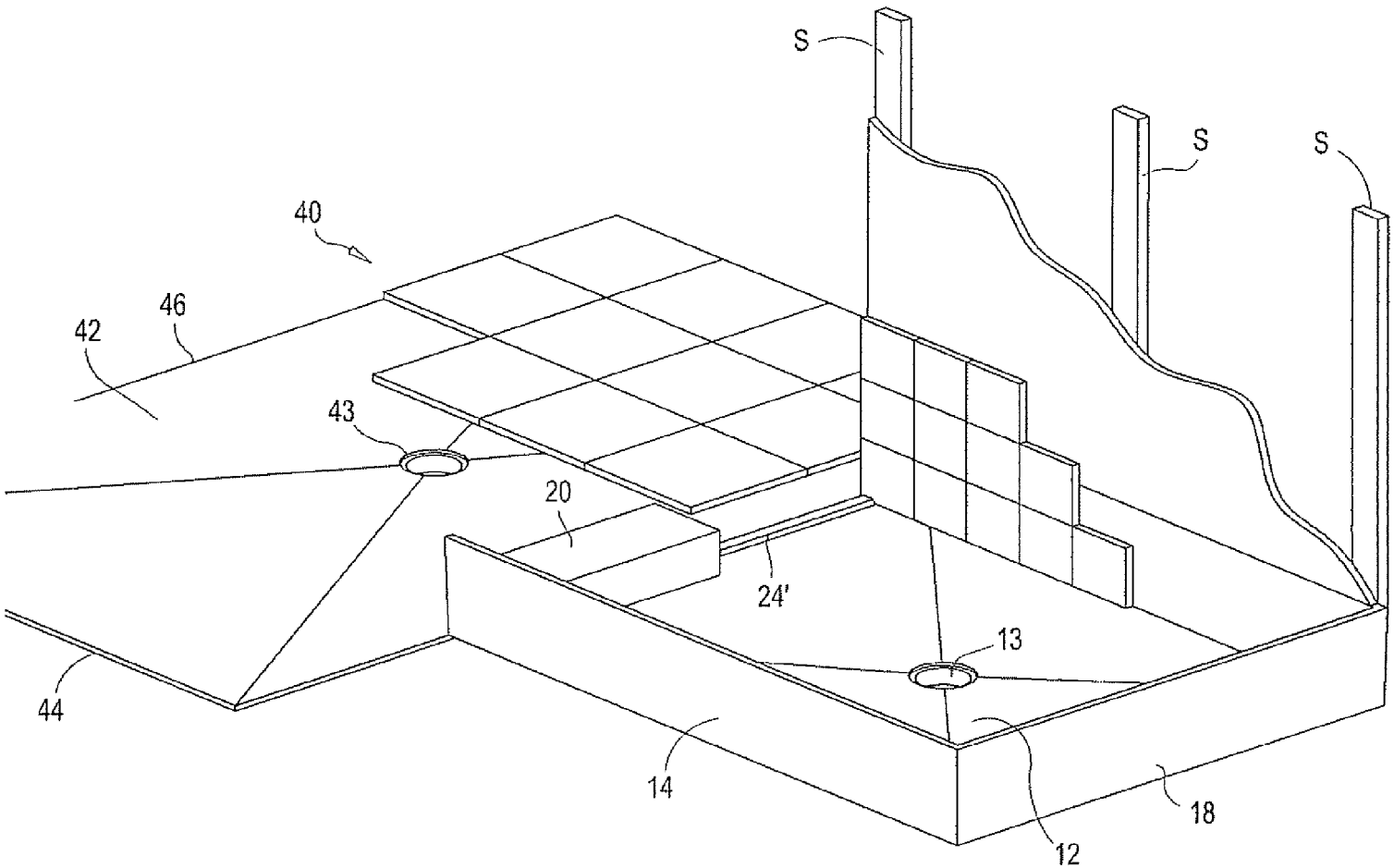
FIG. 9 is a rear perspective view of the handicapped accessible shower and bathroom floor pan arrangement shown in FIG. 3 with wall studs, drywall and tile partially enclosing/covering same, with a raised dam across the threshold between the floor and shower pans.

FIGS. 8 and 9 depict an installed shower pan and bathroom floor pan combination, where the components have been tiled over to create a finished enclosure. It can be seen that shower module 10 is placed within an enclosure defined by wall studs "S", floor pan 40 is placed on bathroom floor F such that edge 50 of pan 40 abuts or is substantially in registry with edge 26 of module 10, and drywall (or other suitable wall-forming structure) applied over studs "S" to form shower enclosure walls, and finish covering material such as tile and grout 70 applied thereover to form a continuously covered shower enclosure and bathroom floor.

In the use of the handicapped accessible arrangement contemplated by this embodiment of the invention, due to the fact that many handicapped accessible showers do not have doors or curbs to prevent water from traveling outside of the shower, it is desirable, and presently commonplace, to employ a drain in the floor area F of the bathroom outside of the shower. Therefore, another aspect of the invention is the provision of one or more drain apertures 43 through the waterproof bathroom floor pan 40 through which water that has escaped the shower may drain. The use of waterproof bathroom floor pan 40 prevents water that may seep through the grout or other surface covering of the floor of the shower and bathroom from accumulating and becoming stagnant under the tile or other floor finishing surface. By using the instant invention, any such water that has intruded below the floor covering tile or other surface material will run down the upper surface of bathroom floor pan 40 and proceed through drain 43.

Installation of the handicapped accessible shower arrangement may be carried out by installing a waterproof shower module 10, or similar waterproof pan, in a shower enclosure as described supra, installing, as by adhering or simply laying, bathroom floor pan 40 on the bathroom floor F, abutting edge 50 of bathroom floor pan 40 against edge 26 of shower pan 10, sealing the joint formed at threshold "T" by the edges 26 and 50 of the shower and bathroom floor pans, respectively, and installing a finishing surface material over the floor 12 of shower pan 10 (and the sidewalls of that pan, as well as the walls of the shower as shown in FIG. 8), bathroom floor pan 40 and threshold "T". Such finishing surface may be comprised of tile and grout, stucco, or the like as will occur those in the art.

It is to be appreciated that any number of drains may be employed in connection with bathroom floor pan 40 such that the number of drain apertures 43 defined by bathroom floor pan 40 should correspond to the number of floor drains in bathroom floor F.

Figure 10:
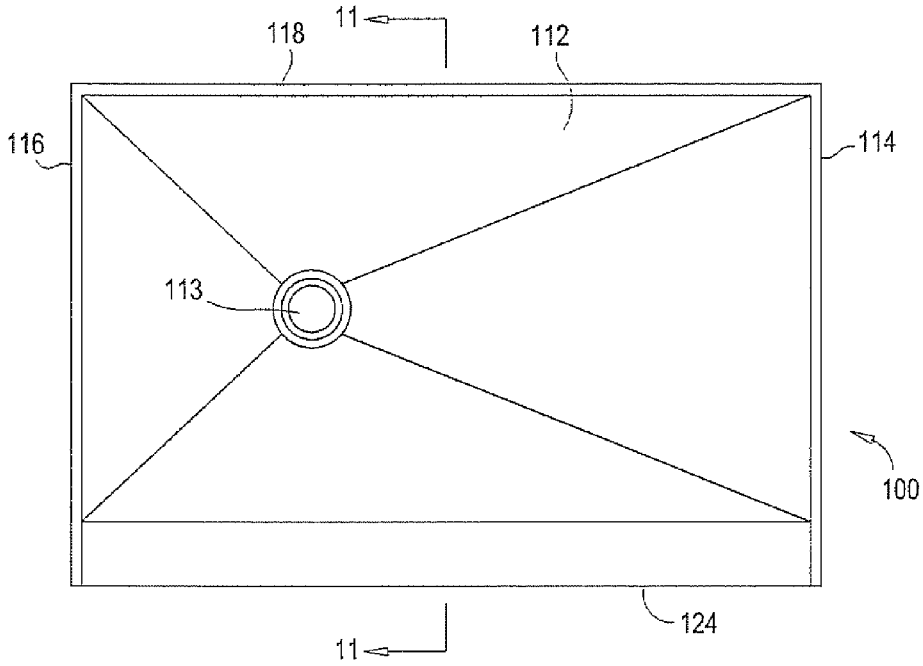
FIG. 10 is a top plan view of the handicapped accessible shower and bathroom floor pan in accordance with a first modified embodiment this invention.
Figure 11:
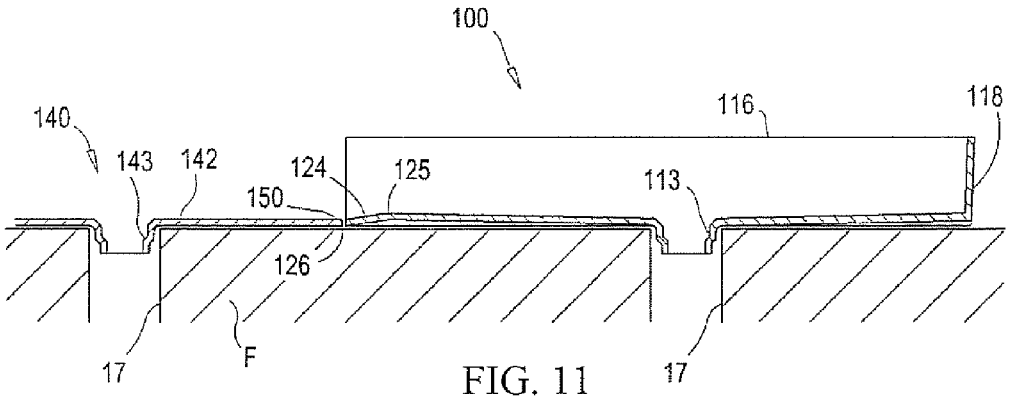
FIG. 11 is a cross-sectional side elevational view of the handicapped accessible shower and bathroom floor pan shown in FIG. 10.
Figure 12:
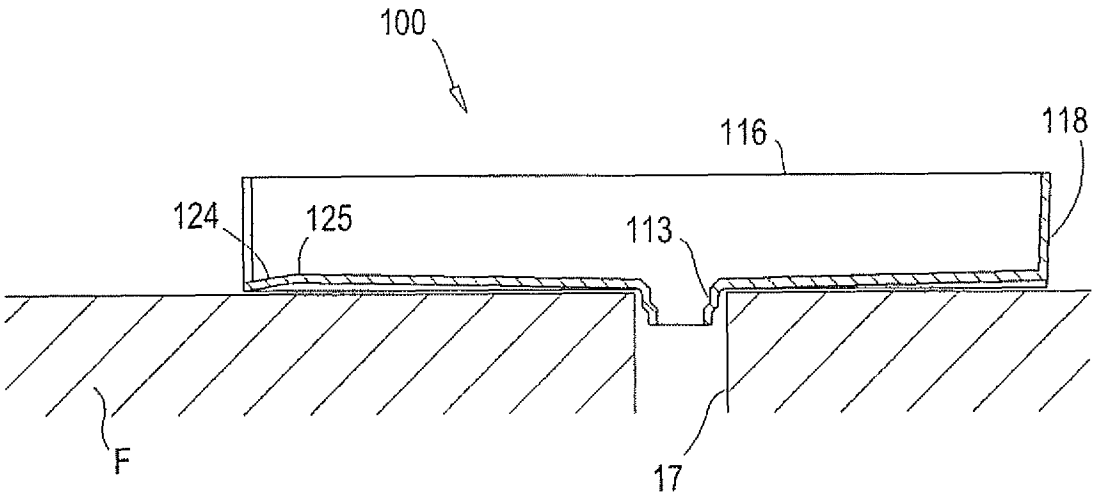
FIG. 12 is a cross-sectional side elevational view of the handicapped accessible shower pan shown in FIG. 10 without the use of a bathroom floor pan in conjunction therewith.
Figure 13:
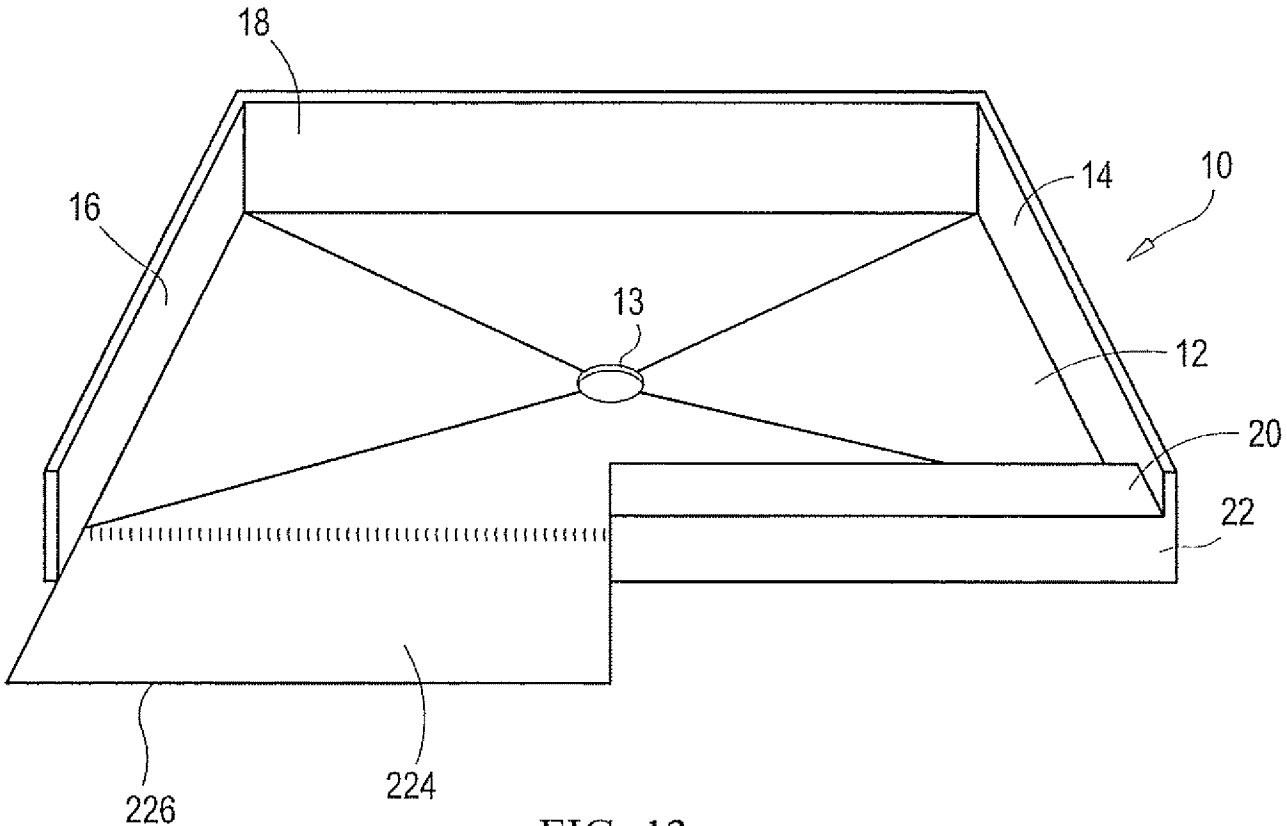
FIGS. 13-16 depict a second modified form of the shower module of this invention.
Figure 14:
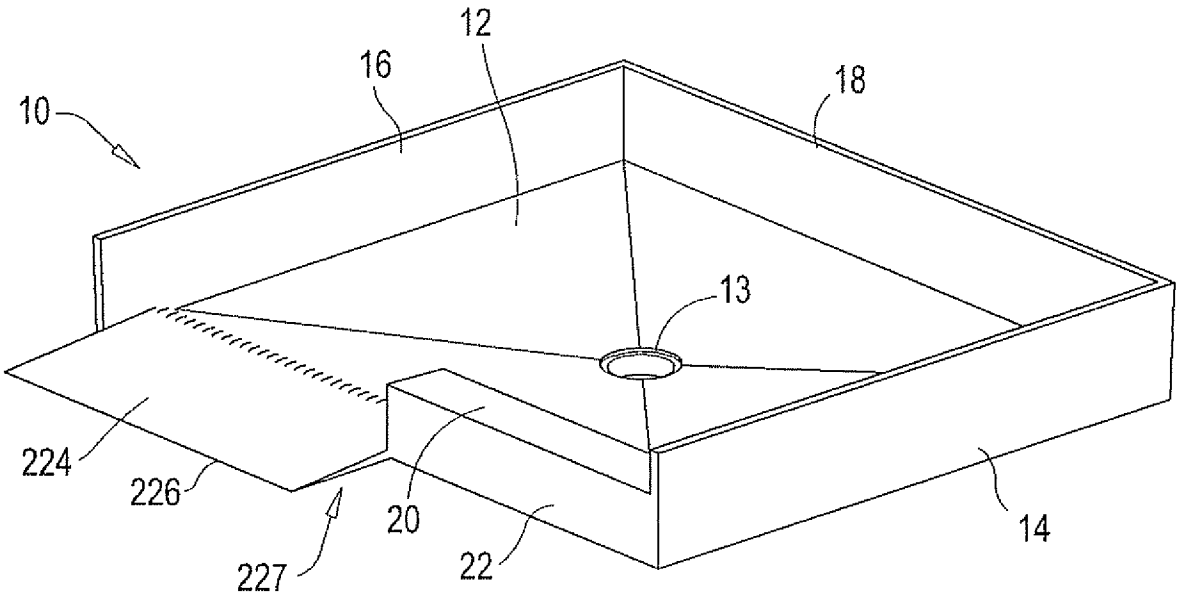
Figure 15:
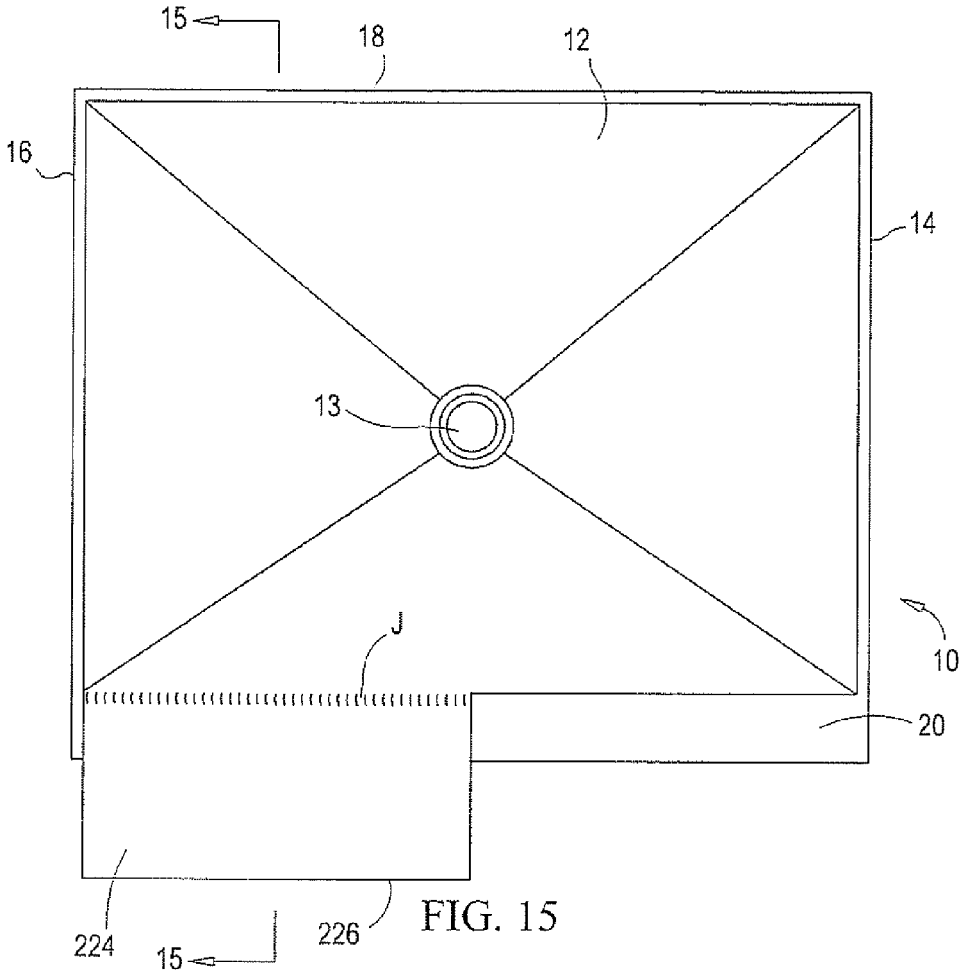

As shown in FIGS. 10-12, a modification can be made to the shower module such that the area of pan floor 112 adjacent the threshold edge 124 is ramped, thereby defining a small water barrier or dam while still facilitating access to the shower by a wheelchair-bound person. In this version, a shower pan or module 100, which may be provided in any shape or size, is provided with a floor 112, and first, second and third sidewalls 114, 116 and 118, respectively. It is to be understood, however, that any number of sidewalls may be employed in this version of the invention. In the embodiment shown, so long as sufficient area is left open through one of the sidewalls through which a wheelchair or other assist device can pass to permit access by a handicapped person to the shower. However, the ramped opening need not be sized to permit access by a wheelchair if the design criteria of a particular installation so dictates.

Typically, shower modules or pans are provided with a number of sidewalls which correspond to the number of adjacent walls of the shower enclosure, and a curb or raised area such as 20 in FIGS. 1-9 across all or a portion of the entry area of the module. These curbs are employed to prevent water from draining out of the shower enclosure and wetting the floor of the bathroom. However, these curbs are typically of a height which requires that they be stepped over in order to gain access to the shower.

In the case of a handicapped person, a curb makes it impossible for the person to enter the shower. For this reason, the modified form of the invention shown in FIGS. 10-12 employs a ramp feature such as ramp section or member 124. Ramp 124 can be molded integrally with pan floor 112 during manufacturing in place of curb 20, such that it will be of a width "a" which substantially coincides with the width of curb 20 of FIGS. 1-9. Alternatively, the ramp could be extended beyond the width of a typical curb into the bathroom until any vertical obstruction to the entrance to the shower has been either eliminated or substantially reduced by the ramp, which is preferably but not by way of limitation pitched at or around an inch per foot from the juncture 125 until it is level or substantially level with the adjacent bathroom floor. Ramp 124 terminates on one side in an upper peak or juncture 125 which is preferably integrally connected to module floor panel 112, and at its other side at a threshold edge 126. Edge 126 is adapted to be placed in registry with corresponding threshold edge 152 of bathroom floor module 140 should such a module 140 be employed in any given installation. Bathroom floor module 140 may be similar to module 40 of FIGS. 1-9. The slope of ramp 124 will be dictated by the distance "a" and the difference in height between edge 126 and peak 125, and in the preferred embodiment is approximately 1 inch per foot. The line in which juncture 125 lays resides in a horizontal plane which is vertically higher than the horizontal plane in which threshold edge 126 lays, as seen in FIGS. 11-12. This will tend to retain water within the module.

To install the shower module 100 and bathroom floor module 140, the shower module is placed within a shower enclosure on the sub-floor (not shown), the bathroom floor module 140 is placed on the sub-floor adjacent to the shower module such that edges 126 and 150 are substantially in registry, and the bathroom and shower modules, as well as the shower walls and any shower accessories, such as a shower bench, are tiled over or otherwise covered with finishing material.

It is contemplated that module 100 may be used without bathroom floor pan 140, in which case the barrier free lip is offset by one or more of the ramp, recessing the subfloor where the shower module and ramp will be placed, or thinset, mortar or other hardenable material (not shown) may be placed on the sub-floor adjacent edge 126 to build the level of the sub-floor up so that when tile or other finishing material is applied over the threshold of the sub-floor and ramp 124, a continuous, smooth surface will result.

The thickness of shower pan floor panel 112 (as well as floor panel 12 of FIGS. 1-9) may be tapered going toward threshold edge 126 (or edge 26 in FIGS. 1-9) so that the height differential between the sub-floor and the upper edge of edge 126 (or edge 26) is minimal, particularly when no bathroom floor pan 40, 140 is used, which in turn reduces the amount of height to be dealt with when installing tile over the juncture of edge 26, 126 and the sub-floor.

FIGS. 13-16 depict a further modified form of the shower module of this invention, wherein a ramp 224 is either integrally molded with pan 10 during manufacturing or otherwise added during manufacturing or, alternatively, added in the field by the installer. Ramp 224 extends beyond the termination of sidewall 16, so as to continue module floor 12 into the bathroom in a manner which makes a gradual transition from the juncture "J" of floor 12 with ramp 224. Side edges 227 define the sides of ramp 224, and front or threshold edge 226 defines the front edge thereof. Edges 227 may be vertical, or may likewise be ramped (not shown) so as to reduce the abruptness of the transition from subfloor F to ramp 224. Additionally, it may be desirable for the installer to raise the subfloor F adjacent edges 227 to facilitate a smooth transition over which to apply floor tile or other finishing material when installing module 10. Ramp 224 may extend any width across the front of pan 10. In the embodiment shown, a partial curb 20 is used to cover a portion of the bathroom-facing edge of pan 10. However, ramp 224 could extend the entire width of that bathroom-facing side, or any portion of it. Moreover, for pans which have more than one side which opens out into the bathroom, a ramp may be used on a portion or all of any of those sides.

Figure 16:
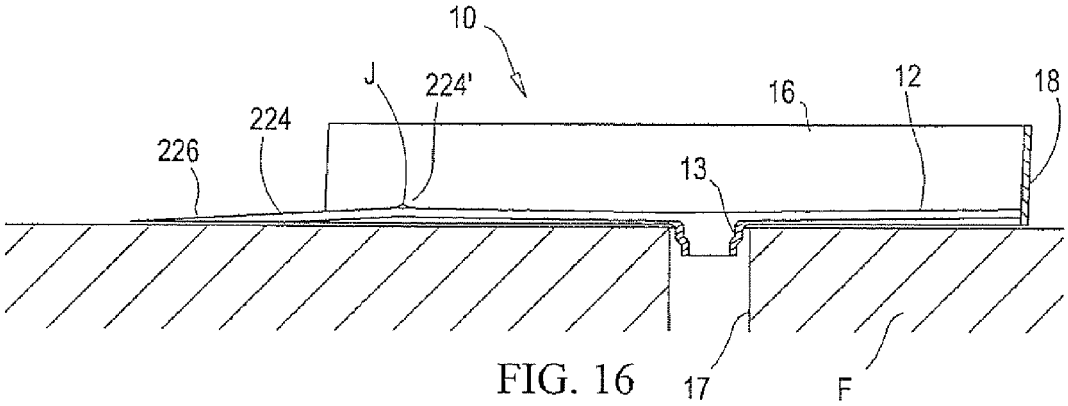

As can be appreciated from FIG. 16, the vertical thickness of ramp 224 may taper when going from right to left in the figure toward edge 226, to make the smoothest transition possible between subfloor F and ramp 224. Alternatively, the thickness of ramp 224 may remain constant, but in any case the upper surface of ramp 224 should be sloped at the juncture "J" where it joins with module floor 12 such that the highest point of ramp 224 will be along junction "J", and the lowest point will be along edge 226. A raised area or ramp 224 may or may not be employed at juncture J to impede water from exiting shower pan 10.

Figure 17:
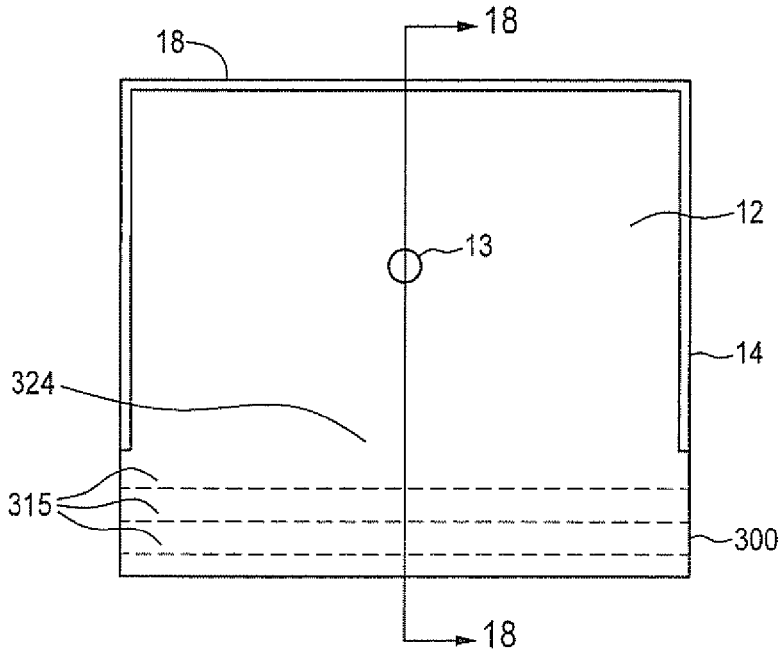
FIGS. 17-19 depict a third modified form of this invention.
Figure 18:
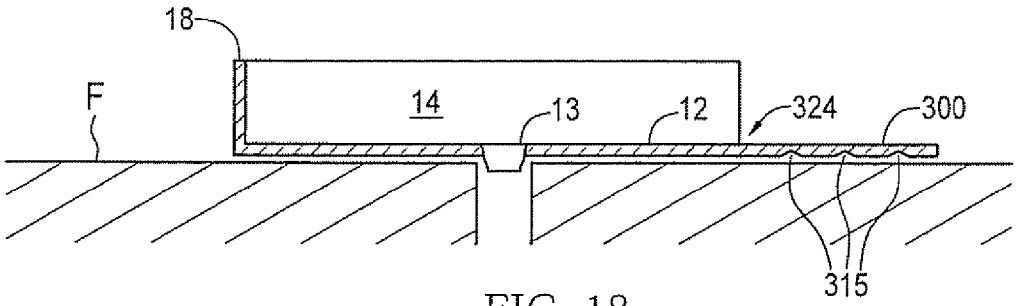
Figure 19:
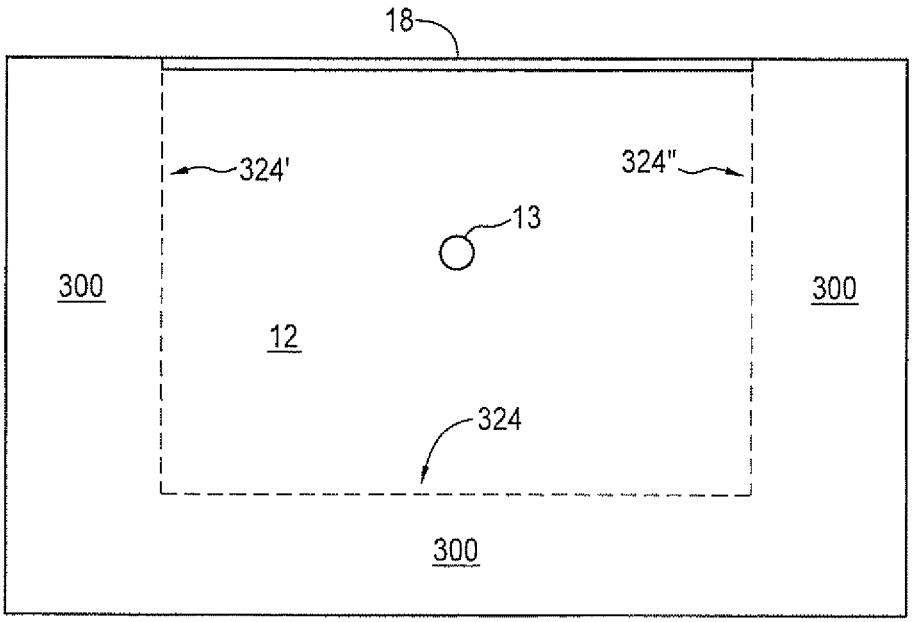

In the embodiment shown in FIGS. 17-19, floor 12 is extended beyond whatever barrier free threshold is incorporated into the module by simply extending floor 12 outwardly from the barrier free threshold with an integrally formed sheet of the same material out of which floor 12 is formed. This type of arrangement is ideally suited for applications where there is no floor drain other than the floor drain with which the module drain opening 13 aligns, and is also ideally suited for applications where the bathroom sub-floor is recessed. Such extensions will be tiled over along with the shower module itself to create a contiguous floor with the bathroom floor to provide additional waterproofing for water which might otherwise seep below the tile immediately adjacent the barrier free threshold on the outside of the module.

FIGS. 17 and 18 show an example of an extension 300 which extends floor 12 of a typical modular shower pan beyond the barrier free threshold 24 out over the bathroom subfloor F. Extension 300 is co-extensive, and integrally formed, with floor 12 such that it forms a water barrier above sub-floor F. Means for facilitating reduction in size of extension 300, such as scoring lines 315 disposed in the underside of extension 300, may be employed to permit the easy removal of a portion of extension 300 in the field in the event that it becomes desirable to reduce the size of extension 300.

Extension 300 may be integrated with floor 12 along any barrier free threshold which the shower module defines. For Example, FIG. 19 shows a shower module having three barrier free edges 324, 324' and 324". It can readily be appreciated that a module may be manufactured having only two barrier free edges, or with one or more partial barrier free edges such as that shown in FIGS. 1-4. The integrally formed extensions may be of any dimension suitable for the circumstances, so long as the juncture of the extension 300 with floor 12 is a contiguous or otherwise water tight connection.

If extension 300 is not formed integrally with floor 12 during manufacture of the module, but is joined with the floor 12 in the field, such joining can be done by gluing, waterproof taping, applying a water proof membrane, etc, as will occur to those of skill in the art, at the interface of extension 300 with floor 12.

As described above, the present invention encompasses a modular system for creating a tiled handicapped accessible shower enclosure including one or more component pieces (e.g., a prefabricated shower module with or without an integrated curb, with or without a prefabricated waterproof shower floor pan defining one or more drain apertures), and methods of installing the associated component pieces. The system offers tremendous flexibility in creating numerous combinations of component pieces, thereby providing many more options for creating modular shower enclosures. The system may be installed in the field in a fraction of the time required using traditional prior art methods, which greatly assists architects, designers, installers and contractors when designing and building multiple types of structures (e.g., newly constructed condominiums, apartment buildings, hotels, dormitories, prisons, pre-manufactured housing, etc.).

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention. For example, the bathroom floor pans 40, 140 are shown having a width which generally corresponds to the width of the adjacent shower module. It is to be understood, however, that the bathroom floor pan may also be wider or narrower than the shower module without departing from the spirit of the invention.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made while this application is pending and all equivalents of those claims as issued.

What is claimed:

1. A method of creating a handicapped accessible shower having a waterproofing feature which reduces the tendency of water to collect and stagnate underneath tile or other floor finishing material installed thereon, comprising the steps of:

installing a shower module in a shower enclosure, the shower module defining a threshold edge which faces a bathroom;

installing a bathroom floor pan on a floor of the bathroom, the floor pan defining an edge adapted to be placed in registry with the threshold edge of the shower module, by placing the threshold edge in registry with the floor pan edge to form a threshold.

2. The method of claim 1, further comprising setting finishing material on a surface area adjacent to the bathroom floor pan and the threshold.

3. A handicapped accessible shower and bathroom floor pan arrangement, comprising:

a waterproof shower module adapted to be installed into a shower enclosure, the shower module defining a threshold edge which is adapted to face toward a bathroom when installed;

a waterproof bathroom floor pan adapted to be placed on a bathroom floor adjacent the shower module;

the bathroom floor pan defining a floor pan edge adapted to be placed in registry with the threshold edge of the shower module; and the shower pan and floor pan each defining upper surfaces adjacent to the threshold edge and the floor pan edge which upper surfaces lie in substantially the same plane so as to form a continuous surface over which finishing material such as tile and grout may be laid.

4. The handicapped accessible shower and bathroom floor pan arrangement of claim 3, further comprising at least one drain aperture defined by the floor pan adapted to be placed in registry with a floor drain.

5. The handicapped accessible shower and bathroom floor pan arrangement of claim 3, further comprising tile set over the juncture of the floor pan edge and the threshold edge.

6. The handicapped accessible shower and bathroom floor pan arrangement of claim 3, further comprising a ramped section disposed between the threshold edge and a floor panel of the shower module.

7. The handicapped accessible shower and bathroom floor pan arrangement of claim 6, further comprising floor tile set on an upper surface of the bathroom floor pan adjacent the floor pan edge and on an upper surface of a floor of the shower module adjacent the threshold edge.

8. The handicapped accessible shower and bathroom floor pan arrangement of claim 6, wherein the ramped section terminates on one side at the threshold edge and on an opposite side at a juncture between the floor and the ramped section, the juncture residing in a substantially horizontal plane which is parallel to and vertically higher than a substantially horizontal a plane in which the threshold edge resides.

* * * * *